US006656041B1

(12) United States Patent
Kaminkow et al.

(10) Patent No.: US 6,656,041 B1
(45) Date of Patent: Dec. 2, 2003

(54) GAMING DEVICE FOR CHANGING A PLAYER'S ENVIRONMENT

(75) Inventors: Joseph E. Kaminkow, Reno, NV (US); Brian K. Baker, Reno, NV (US); Daniel J. Waller, Reno, NV (US)

(73) Assignee: IGT, Reno, NV (US)

( * ) Notice: Subject to any disclaimer, the term of this patent is extended or adjusted under 35 U.S.C. 154(b) by 397 days.

(21) Appl. No.: 09/689,402

(22) Filed: Oct. 12, 2000

(51) Int. Cl.[7] ..... A63F 9/24
(52) U.S. Cl. ..... 463/16; 273/143 R
(58) Field of Search ..... 463/1–16, 30–35, 463/43, 46, 47; 273/121 B, 143 R; 352/25, 85; 239/370; 472/65

(56) References Cited

U.S. PATENT DOCUMENTS

| | | | | |
|---|---|---|---|---|
| 4,243,616 A | * | 1/1981 | Wyss | 261/122.1 |
| 4,272,019 A | | 6/1981 | Halaby, Jr. | |
| 4,670,798 A | | 6/1987 | Campbell et al. | |
| 5,120,060 A | | 6/1992 | Parker et al. | |
| 5,362,049 A | | 11/1994 | Höfer | |
| 5,470,082 A | | 11/1995 | Clayton | |
| 5,560,603 A | | 10/1996 | Seelig et al. | |
| 5,562,286 A | | 10/1996 | Brinket | |
| 5,833,538 A | | 11/1998 | Weiss | |
| 5,923,252 A | | 7/1999 | Sizer et al. | |
| 6,053,738 A | | 4/2000 | Ivey, Jr. | |
| 6,071,192 A | | 6/2000 | Weiss | |
| 6,126,165 A | | 10/2000 | Sakamoto | |
| 6,152,829 A | * | 11/2000 | Jaidka | 472/65 |
| 6,169,595 B1 | | 1/2001 | Manne | |
| 6,328,648 B1 | | 12/2001 | Walker et al. | |
| 6,375,568 B1 | | 4/2002 | Roffman et al. | |
| 6,409,595 B1 | | 6/2002 | Uihlein et al. | |
| 6,517,437 B1 | | 2/2003 | Wells | |
| 6,530,842 B1 | | 3/2003 | Wells et al. | |
| 2002/0175541 A1 | * | 11/2002 | Floyd, Jr. | 297/180.12 |

FOREIGN PATENT DOCUMENTS

| | | | |
|---|---|---|---|
| JP | 8-280927 | * 10/1996 | A63F/7/02 |
| WO | WO 9814251 | 4/1998 | |

OTHER PUBLICATIONS

Whirlwind Brochure published by Williams Electronics Games, Inc. in 1990.*
Mega Jackpots Brochure published by IGT in 1998.
Wheel of Fortune Brochure published by IGT in 1998.
Star Rider Brochure published by Williams Electronics Games, Inc. in 1983.
Whirlwind Brochure published by Williams Electronics Games, Inc. in 1990.
Description of Sound Effects in Gaming Devices published by IGT.
Earthshaker Brochure published by Williams Electronics Games, Inc. in 1984.
X–Fogger Advertisement (website) written by antari.com, printed Apr. 24, 2003.

* cited by examiner

*Primary Examiner*—Kim Nguyen
(74) *Attorney, Agent, or Firm*—Bell, Boyd & Lloyd LLC

(57) ABSTRACT

The present invention relates to a method and apparatus for emulating a storm associated with a gaming device. The invention includes a topper unit connected to the housing of the gaming device, where the topper unit includes a blower mechanism to create an air stream that emulates winds associated with a storm. The topper unit further includes an illumination source that emulates lightening associated with a storm. Thunder is provided by a sound card that transmits the thunder through speakers attached to the gaming device.

45 Claims, 3 Drawing Sheets

GAMING DEVICE FOR CHANGING A PLAYER'S ENVIRONMENT

CROSS REFERENCE TO RELATED APPLICATIONS

This application is related to the following commonly-owned co-pending patent applications: "A GAMING DEVICE HAVING A PHYSICAL STIMULI GENERATOR," Ser. No. 09/978,952.

DESCRIPTION

The present invention relates in general to a gaming device, and more particularly to a gaming device for changing a player's environment, preferably in conjunction with an award or as part of a bonus round.

BACKGROUND OF THE INVENTION

Known gaming machines use various lighting effects and sound effects to attract, stimulate and entertain players. Such games, for instance, include flashing lights, spinning lights, music, and voices for such purposes. Gaming machines also include bonus schemes, progressive jackpots and large awards to attract, stimulate and entertain players. To increase player enjoyment and excitement, it is desirable to provide new player stimuli in conjunction with gaming devices.

SUMMARY OF THE INVENTION

The present invention provides a gaming device which stimulates the player by changing the player's environment, preferably in conjunction with an award or bonus scheme, thereby increasing the player's enjoyment and excitement. The gaming device of the present invention includes a topper unit mounted on the top of the cabinet of the gaming device which emulates certain stimuli to the player, including air movement or wind, lighting effects and sound effects. The topper unit includes a housing and diffuser that provide the stimulus that supplements the primary or secondary games of the gaming device.

In one preferred embodiment, the present invention provides stimuli relating to a storm, such as a thunderstorm. The housing includes one or more illumination devices that simulates lightning flashing through a thundercloud, while thunder sounds are provided by a soundcard and transmitted through speakers. The present invention provides a blower mechanism contained in the topper unit fluidly communicating with the diffuser. The blower mechanism, preferably including a plurality of fan blades and a drive mechanism which generates a pulsed or steady stream of air (i.e., air stream) that is provided to the diffuser. The diffuser acts to control the air stream reducing its force so that the player is not unduly startled or injured. The diffused air stream is directed toward the player and temporarily changes the player's environment, preferably in conjunction with a player award, bonus game or other event.

It is therefore an object of the present invention to provide a gaming device that changes a player's environment.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 3 is an exploded front perspective view of the topper unit including the illumination and blower mechanisms of the present invention illustrating the relationship there between.

DETAILED DESCRIPTION OF THE INVENTION

Figure 1:
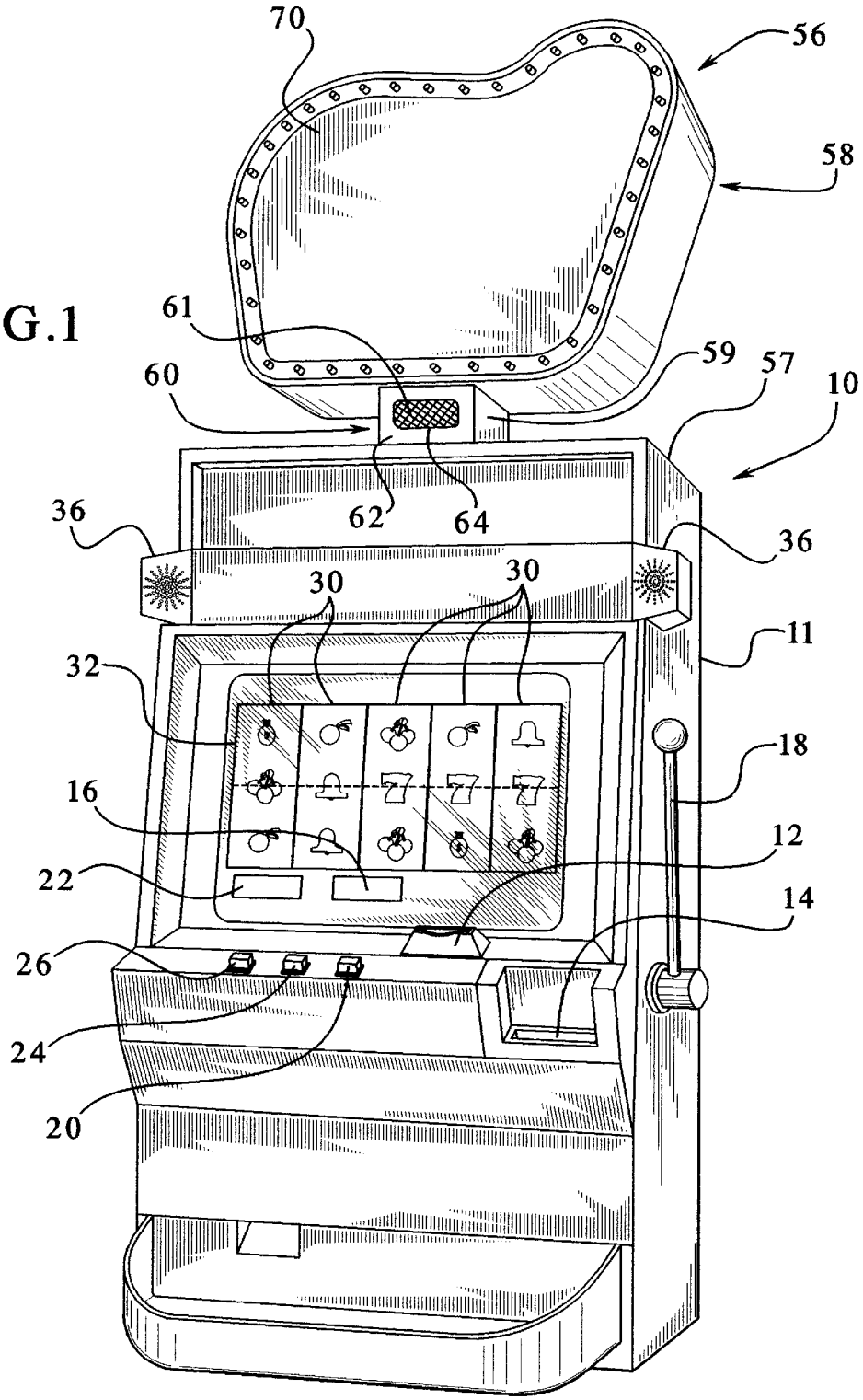
FIG. 1 is a front perspective view of one embodiment of the gaming device of a preferred embodiment of the present invention.

Referring now to the drawings, a gaming device 10 of one embodiment of the present invention, which is preferably a slot machine having the controls, displays and features of a conventional slot machine is generally illustrated. Gaming device 10 includes a cabinet 11 constructed to enable a player to operate gaming device 10 while standing or sitting. However, it should be appreciated that gaming device 10 can be constructed as a pub-style table-top game (not shown) which a player can operate preferably while sitting.

Gaming device 10 can incorporate any primary game such as slot, poker or keno in addition to any of their bonus triggering events which trigger a bonus round. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism (including a touch screen) which starts the game.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 may include a display window which contains, in the slot machine embodiment, a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at display 32.

Figure 2:
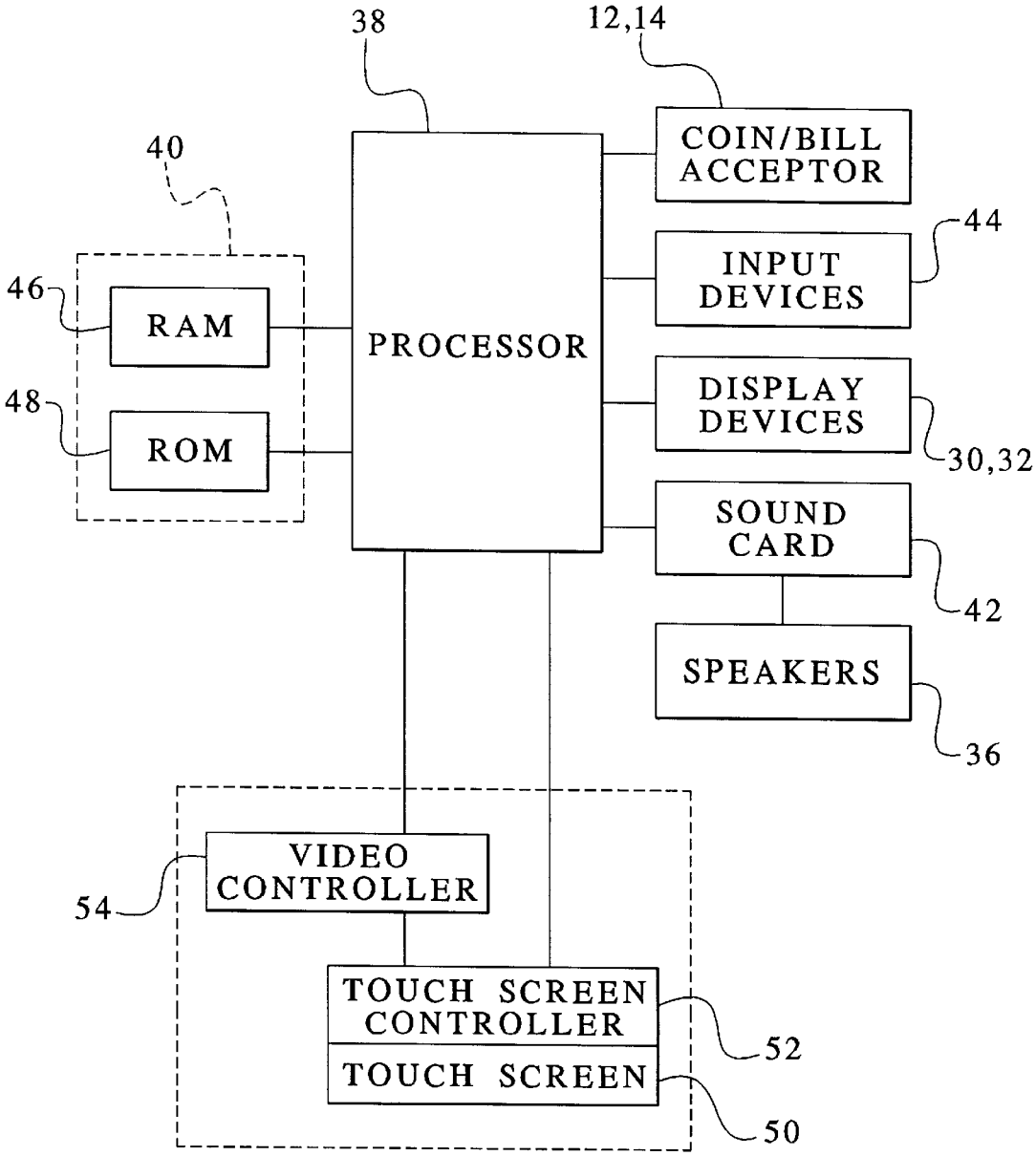
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 32 (not shown in FIG. 1); a display 30; a sound card 42 for generating sounds, such as thunder or other storm sounds; a plurality of speakers 36; and one or more input devices 44. The processor 38 is preferably a microprocessor or microcontroller-based platform which is capable of displaying images, symbols and other indicia such as images of people, characters, places, things, faces of cards, an image of storms, such as clouds and rain; and controlling the illumination and blower mechanisms described below. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1 and 2, to operate the gaming device 10 in one embodiment the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also provides players the opportunity to win credits in a bonus round. This type of gaming device 10 will include a program which will automatically begin a bonus round when the player has achieved a qualifying condition in the primary game. This qualifying condition can be a particular arrangement of indicia on a display device. The gaming device 10 preferably uses the video-based display 32 to enable the player to play the bonus round. Preferably, the qualifying condition is a predetermined combination of indicia appearing on a plurality of reels 30.

In one embodiment, the present invention includes a gaming device 10 that emulates the sights, sounds and feel of a storm and in particular a thunderstorm. The gaming device 10 includes a topper unit 56 connected to and mounted on top of the cabinet 11 of the gaming device 10. The gaming device 10 uses the topper unit 56 to entice players to play the game, stimulate a player playing the game, and increase their enjoyment while playing, adding external stimulus that supplements the primary or secondary (i.e., bonus game) game.

As illustrated in FIG. 1, the topper unit 56 generally includes a housing 58 and diffuser 60 that provide the outside stimulus that supplements the primary or secondary game. In the illustrated embodiment, the diffuser 60 is connected to cabinet 11 of the gaming device (preferably to a top surface 57 thereof by screws, bolts, pegs, adhesives, or other suitable means. The diffuser 60 includes a diffuser housing 59 defining a opening 61 in a front surface 62 thereof and includes a screen or mesh 64 therein. The diffuser 60 is in fluid communication with a blower mechanism 66 as discussed in greater detail below. The diffuser housing 59 is preferably formed as a single piece of non-transparent, colored or dyed plastic, but other materials are contemplated including polyvinylchloride, polyvinylacetate, acrylic, or other suitable material. Moreover, it should be anticipated that housing 59 could be formed of a plurality of units joined together and comprising one integral unit.

The housing 58 is connected to the diffuser 60 using screws, bolts, pegs, adhesives or other suitable fixing devices. In the illustrated embodiment, the housing 58 has a rounded appearance so that it looks like a storm cloud. It should be appreciated that the housing 58 can have any shape (square, round, oval, triangular, etc.) suitable for use with the gaming device 10 and the game. The housing 58 is preferably formed as a single piece of non-transparent, colored or dyed plastic, but other materials are contemplated including polyvinylchloride, polyvinylacetate, acrylic, or other suitable material. Moreover, it should be anticipated that housing 58 could be formed of a plurality of units joined together and comprising one integral unit.

The depicted housing 58 includes an illumination device 68 (best viewed in FIG. 3) that provides a lighting effect such as simulating lightning. The housing 58 also includes a opaque or translucent plastic face plate 70 removably connected thereto which acts to diffuse the light, heightening the lightening effect. It should be appreciated that the face plate 70 may also display the name of the primary or secondary game. While an opaque or translucent plastic face plate 70 is discussed, other suitable materials are contemplated.

Figure 3:
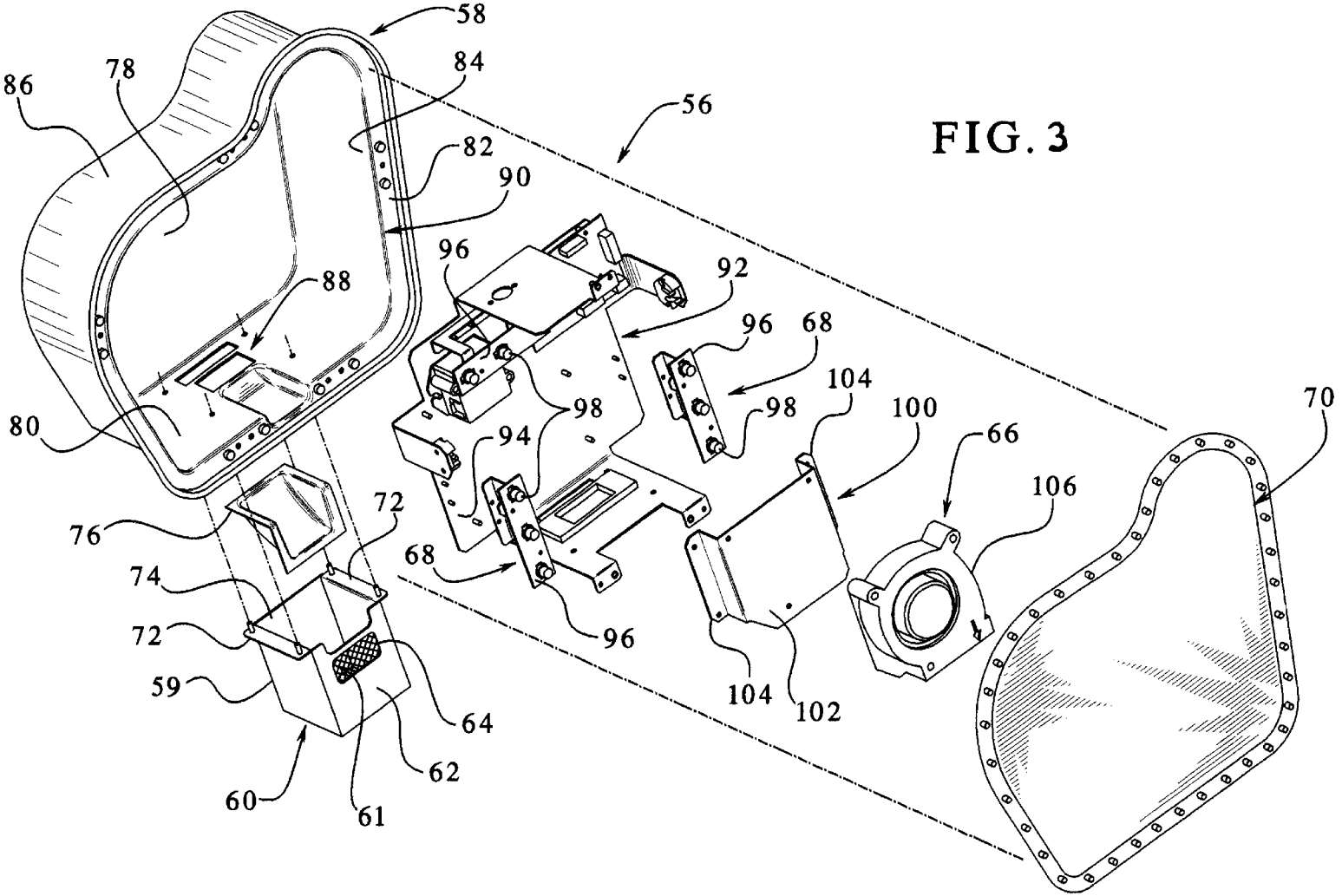

Turning now to FIG. 3, the topper unit 56 is shown in greater detail. The diffuser 60 includes the diffuser housing 59 defining opening 61 (containing screen 64) in the front surface 62 thereof. The diffuser 60 includes opposing extending members 72 that removably connect to the housing 58 using any suitable fastening device.

The diffuser housing 59 defines a chamber 74 containing a curved trough 76 which fluidly communicates with the housing 58 and provides a path for an air stream through the topper unit 56 and out the opening 61. It should be appreciated that diffuser 60 acts to control the air stream, reducing or diffusing the air stream power, preventing the air stream from injuring or annoying the player.

The housing 58 includes a first or generally flat back surface 78 and a second surface or wall 80 connected to and extending therefrom. The second surface or wall 80 has a lip 82 extending transversely therefrom, and includes inner and outer surfaces 84 and 86, respectively, where the outer surface 86 connects to the extending members 72 of the diffuser 60. The second surface or wall 80 further defines a port 88 that fluidly communicates with the diffuser 60 and the trough 76.

In the preferred embodiment, the first and second surfaces 78 and 80 define a chamber 90 that contains the illumination device 68 and a blower mechanism 66. The chamber 90 contains a first support member 92 removably connected to the first surface 78 by screws, bolts, pegs, adhesives or other suitable fastening devices. The first support member 92 has a support surface 94 with a plurality of illumination supports or sockets 96 extending therefrom and removably connected thereto.

The illumination supports or sockets 96 support the illumination device 68 connected to the controller or computer, which enable the device 68 to flash in a regular or irregular pattern (emulating lightening during a storm) as determined by the controller. In the illustrated embodiment, the illumination device 68 is a plurality of light bulbs 98 connected to a power source (not shown). While light bulbs 98 are illustrated, any suitable light source including light emitting diodes "LEDs", light beams, fluorescent tubes, electro-luminesence or fiber optic cable are contemplated. It is also contemplated that the illumination device 68 could all be of one color or various colors.

A second support member 100 is illustrated in FIG. 3 connected to the first support member 92 and extending therefrom. The second support member 100 includes a support surface 102 and support members 104 which connect to the first support member 92 using screws, bolts, pegs, adhesives, or other fastening devices. The blower mechanism 66 is shown connected to the support surface 102 of the second support member 100, where the blower mechanism 66 is connected to the controller.

In one preferred embodiment, the blower mechanism 66 includes a drive mechanism and fan blades (not shown) contained in housing 106 which creates a pulse of air (i.e., air stream) simulating high winds associated with a thunderstorm. While the drive mechanism and fans are discussed, any suitable blower mechanism 66 is contemplated. It should be appreciated that the blower mechanism 66 provides the air stream in both a pulsed and non-pulsed (i.e., continuous or non-continuous) pattern.

It is contemplated that the present invention preferably works in conjunction with a bonus scheme of a gaming device 10, where the game initiates the bonus round based on a predetermined pattern in the primary game and the game then enters the bonus scheme or bonus round. However, it should be appreciated that the present invention could be used with a primary game of a gaming scheme in conjunction with an event or occurrence during the game, such as an award to the player.

In one preferred embodiment, the gaming device 10 emulates a thunderstorm when triggered by the controller, based on a triggering event generated by the primary or secondary game. The illumination device 68 emulates lightening, providing light in a pulsed or irregular pattern as determined by the controller. It should be appreciated that the face plate 70 could include a thundercloud pattern that heightens the lightening effect. The sound card 42 generates thunder transmitted to the player by the speakers 36. The blower mechanism 66 generates an air stream (pulsed or non-pulsed) that is provided through the topper unit 56 to the player in a controlled or diffused fashion by the diffuser 60.

It should be appreciated that the above described events provide certain sights, sound and feel of a thunderstorm, heightening the player's enjoyment of the game. Furthermore, the present invention could include a detector which detects passersby. In this embodiment, when someone passes by the gaming device 10, the topper unit 56 lights up, creates thunder and provides a stream of air to attract their attention. In yet another embodiment, the gaming device could emulate a storm on a timed or regular basis to attract players.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a primary game operable upon a wager by a player;

a secondary game initiated upon the occurrence of a triggering event in the primary game, said secondary game including a plurality of different secondary game events;

a housing;

a controller contained in the housing; and means connected to the controller for creating an air stream directed out of the housing toward the player caused by and after an occurrence of on at least one of the secondary game events.

2. The gaming device of claim 1, which includes means for directing the air stream at a player in front of the housing.

3. The gaming device of claim 1, which includes a topper unit containing the air stream means connected to the housing.

4. The gaming device of claim 1, wherein the air stream means includes a blower mechanism.

5. The gaming device of claim 4, wherein the blower mechanism includes at least one fan blade.

6. The gaming device of claim 1, wherein the air stream means is operable to generate a pulsed air stream.

7. The gaming device of claim 1, wherein the air stream means is operable to generate a steady air stream.

8. The gaming device of claim 1, including a diffuser connected to the housing and in fluid communication with the air stream means.

9. The gaming device of claim 1, wherein the diffuser includes a trough in fluid communication with the housing.

10. The gaming device of claim 1, wherein at least one of the secondary game events includes an award provided to the player.

11. The gaming device of claim 1, wherein at least one of the secondary game events includes an award triggering event in the secondary game.

12. A gaming device for emulating certain characteristics of a natural weather occurrence, said gaming device comprising:

a primary game operable upon a wager by a player;

a secondary game initiated upon the occurrence of a triggering event in the primary game, said secondary game including a plurality of different secondary game events;

a housing;

a controller contained in the housing;

means connected to the controller for generating an air stream emulating winds associated with a natural weather occurrence in conjunction with at least one of the secondary game events;

means connected to the controller for emulating visual weather effects in conjunction with said secondary game event; and means connected to the controller for emulating audio weather effects in conjunction with said secondary game event.

13. The gaming device of claim 12, which includes a topper unit containing the air stream means connected to the housing.

14. The gaming device of claim 13, wherein the topper unit contains the visual weather effects emulation means.

15. The gaming device of claim 13, wherein the topper unit contains the audio weather effects emulation means.

16. The gaming device of claim 12, wherein the air stream means includes a blower mechanism.

17. The gaming device of claim 12, wherein the visual weather effects emulation means includes an illumination device.

18. The gaming device of claim 12, wherein the audio weather effects emulation means includes a sound card.

19. The gaming device of claim 18, wherein the audio weather effects emulation means further includes at least one speaker.

20. The gaming device of claim 12, wherein at least one of the secondary game events includes an award provided to the player.

21. The gaming device of claim 12, wherein at least one of the secondary game events includes an award triggering event in the secondary game.

22. A blower mechanism for use with a gaming device, said blower mechanism comprising:

means for creating an air stream and directing the air stream toward a player in conjunction with at least one game event in a secondary game, wherein the secondary game is initiated upon the occurrence of a triggering event in a primary game; and a diffuser fluidly communicating with the air stream means.

23. The blower mechanism of claim 22, including a controller connected to the air stream means.

24. The blower mechanism of claim 22, wherein the air stream means includes at least one fan blade.

25. The blower mechanism of claim 22, wherein the blower mechanism includes a drive mechanism connected to said controller.

26. A method for a gaming device for displaying weather effects associated with a game, said method comprising:

displaying a primary game to a player, said primary game operable upon a wager by the player;

displaying a secondary game upon the occurrence of a triggering event in the primary game, said secondary game including a plurality of different secondary game events;

generating an air stream using a blower mechanism connected to said gaming device and directing the air stream toward the player based on at least one of the secondary game events;

creating visual weather effects using an illumination source based on said secondary game event; and generating audio weather effects sounds through speakers connected to said gaming device based on said secondary game event.

27. The method of claim 26, which includes controlling at least the air stream using a controller connected to the blower mechanism.

28. The method of claim 26, which includes controlling at least the visual weather effects using a controller connected to the illumination source.

29. The method of claim 26, which includes controlling at least the audio weather effects using a controller connected to the sound card.

30. The method of claim 26, including providing the audio weather effects sound through at least one speaker connected to the gaming device.

31. The method of claim 26, which includes creating a pulsed air stream.

32. The method of claim 26, which includes creating a steady air stream.

33. The method of claim 26, wherein at least one of the secondary game events includes an award provided to the player.

34. The method of claim 26, wherein at least one of the secondary game events includes an award triggering event in the secondary game.

35. A gaming device comprising:

a primary game operable upon a wager by a player;

a secondary game initiated upon the occurrence of a triggering event in the primary game, said secondary game including a plurality of different secondary game events;

a housing;

a controller operable to control the primary game and the secondary game; and a blower mechanism attached to the housing and controlled by the controller, wherein the blower mechanism is operable to generate and direct an air stream from the housing toward the player based on at least one of the secondary game events.

36. The gaming device of claim 35, which includes a topper unit containing the blower mechanism, wherein the topper unit is connected to the housing.

37. The gaming device of claim 35, wherein the blower mechanism includes at least one fan blade.

38. The gaming device of claim 35, wherein the blower mechanism is operable to generate a pulsed air stream.

39. The gaming device of claim 35, wherein the blower mechanism is operable to generate a steady air stream.

40. The gaming device of claim 35, including a diffuser connected to the housing and in fluid communication with the blower mechanism.

41. The gaming device of claim 40, wherein the diffuser includes a trough in fluid communication with the housing.

42. A gaming device which displays weather effects associated with a game, said gaming device comprising:

a primary game operable upon a wager by a player;

a secondary game initiated upon the occurrence of a triggering event in the primary game, said secondary game including a plurality of different secondary game events;

a housing;

a controller operable to control the primary game and secondary game;

a blower mechanism connected to the housing and controlled by the controller, said blower mechanism operable to generate an air stream emulating wind in conjunction with at least one of the secondary game events;

an illumination device connected to the housing and controlled by the controller, said illumination device operable to create visual weather effects in conjunction with said secondary game event; and an audio device connected to housing and controlled by the controller, said audio device operable to generate audio weather effects in conjunction with said secondary game event.

43. The gaming device of claim 42, which includes a topper unit containing at least one of the blower mechanism, illumination device and the audio device, wherein the topper unit is connected to the housing.

44. The gaming device of claim 42, wherein the audio device includes a sound card.

45. The gaming device of claim 44, wherein the audio device further includes at least one speaker in communication with the sound card.

* * * * *